US008396090B2

(12) United States Patent
Ullman

(10) Patent No.: US 8,396,090 B2
(45) Date of Patent: Mar. 12, 2013

(54) WINDOW MOUNTED BEAM DIRECTOR

(75) Inventor: Alan Z. Ullman, Northridge, CA (US)

(73) Assignee: The Boeing Company, Chicago, IL (US)

( * ) Notice: Subject to any disclaimer, the term of this patent is extended or adjusted under 35 U.S.C. 154(b) by 676 days.

(21) Appl. No.: 12/566,947

(22) Filed: Sep. 25, 2009

(65) Prior Publication Data

US 2011/0075234 A1 Mar. 31, 2011

(51) Int. Cl.
*H01S 3/10* (2006.01)
*F41G 1/00* (2006.01)

(52) U.S. Cl. ..... 372/9; 42/114

(58) Field of Classification Search . 372/9; 42/114–129
See application file for complete search history.

(56) References Cited

U.S. PATENT DOCUMENTS 4,614,913 A * 9/1986 Honeycutt et al. ..... 359/333
7,440,190 B2 10/2008 Ullman
8,023,536 B1 * 9/2011 Billman ..... 372/4
2008/0042042 A1 * 2/2008 King et al. ..... 250/201.9
2009/0052478 A1 2/2009 Vassberg et al.
2010/0128244 A1 * 5/2010 Koehler et al. ..... 356/4.01
2011/0103410 A1 * 5/2011 Hutchin ..... 372/9

OTHER PUBLICATIONS

Schwartz, Craig, A New Look at Risley Prisms, Photonics Spectra, Jun. 2006 (reprint) as downloaded from http://www.photonics.com/Content/ReadArticle.aspx?ArticleID=25652, Sep. 14, 2009.

* cited by examiner

*Primary Examiner* — Alessandro Amari
*Assistant Examiner* — Kimberly N Kakalec
(74) *Attorney, Agent, or Firm* — Felix L. Fischer

(57) ABSTRACT

A laser system employs a window integrated in the surface of a weapon platform. A high energy laser is mounted in the weapon platform to provide a laser beam which is received by a Coude' path for internal direction of the beam. A beam director receives the laser beam from the Coude' path and employs an outer steering assembly and an inner steering assembly to cooperatively provide pointing of a centerline of the laser beam at a substantially single location on the window for a full conical field of regard.

18 Claims, 8 Drawing Sheets

WINDOW MOUNTED BEAM DIRECTOR

BACKGROUND INFORMATION

1. Field

Embodiments of the disclosure relate generally to the field of laser beam direction and more particularly to embodiments for a laser beam direction system incorporated with a window and achieving a required field of regard (FOR) for the laser weapon, or conversely maximizes the FOR for a given size window.

2. Background

Current airborne laser weapons utilize beam projectors either mounted in a turret arrangement on the nose of the aircraft fuselage as exemplified by the Airborne Ballistic Laser (ABL) operating on a modified Boeing 747-400F aircraft or which are deployed through a hole in the fuselage beneath the aircraft as employed in the Advance Tactical Laser (ATL) system currently integrated on C-130 aircraft.

The nose turret solution such as that adopted in the ABL occupies a location which is not feasible for many smaller aircraft for structural and aerodynamic reasons. The solution employing deployment through a fuselage hole is unacceptable beyond a certain Mach number and cannot be concealed readily.

Mounting of a conventional beam director behind a window causes the center of the beam to be displaced substantially as the beam director is positioned to orient a beam at a desired 3 dimensional angle. The offset of the center point of the emanating beam creates angulation of the beam which then slews across the window. The resulting location on the window of the beam center line and lateral extent of the beam therefore varies significantly. The window must consequently be enlarged to receive the entire beam width within the field of regard (FOR) for the beam created by the beam director. This would cause the size of the enclosing window to increase substantially. The size of the laser window is a significant issue because highly specialized and costly glasses must be used to achieve the low adsorption level required to avoid excessive adsorption in, and heating of, the window as well as excessive distortion of the laser beam. Extremely large pieces of such glasses are extremely costly or may require development of larger vacuum furnaces for fabrication and polishing. The window must conform to the complex curvature of the aircraft to minimize aero-optic effects on the laser beam. The complex curvature in the window is in itself a source of distortion of the laser beam and degradation in the performance of the laser system. All of these issues become more critical and complex where there are special surface treatment requirements for the aircraft such as stealth capability.

It is therefore desirable to provide a beam direction system for future airborne laser weapons which may be deployed on aircraft that require the beam use a projection system which is internal to the skin of the aircraft due to speed of operation of the aircraft, desired location of the beam projector, or stealth characteristics of the aircraft while minimizing the required window size to accommodate the necessary FOR for the beam.

SUMMARY

Exemplary embodiments provide laser system which employs a window integrated in the surface of a weapon platform. A high energy laser is mounted in the weapon platform to provide a laser beam which is received by a Coude' path for internal direction of the beam. A beam director receives the laser beam from the Coude' path and employs an outer steering assembly and an inner steering assembly to cooperatively provide pointing of a centerline of the laser beam at a substantially single location on the window for a full conical field of regard.

In one exemplary embodiment, a pair of Risely prisms is employed and the outer steering assembly incorporates an outer mounting ring supporting the first prism for rotational motion and the inner steering assembly incorporates an inner mounting ring supporting the second prism for rotational motion. Relieving the window to receive the outboard Risley prism allows close exit of the beam in from the prism in the window to achieve pointing of the laser beam centerline at a substantially single location on the window for a full conical field of regard.

In a second exemplary embodiment, a telescope mounted on a pantograph is employed. In a first configuration the pantograph employs a plurality of telescoping arms mounted to the weapon platform with ball joints as the outer steering assembly. The inner steering assembly has a telescope frame carried by the telescoping arms that rotationally supports a mounting hoop for first angular rotation of the telescope and engages an axial support for the telescope for second angular rotation of the telescope. The telescoping arms of the outer steering assembly provide multiple axis orthogonal positioning of the telescope frame for clearance of the telescope in rotational motion.

In an alternative configuration of the pantograph the outer steering assembly is a first gimbal created by a tracked ring for azimuth positioning of the beam director. The inner steering assembly is a second gimbal created by a pair of tracked arcs mounted to the first gimbal and carrying the telescope for rotation in elevation to position a beam centerline of the laser beam at substantially the same location on the window.

The embodiments disclosed are employed as a method for implementing beam control in a laser weapon. A window is incorporated integral with the structure of the weapon platform and a laser beam is directed onto the window from a high energy laser through a beam control system. The beam is internally directed with a Coude' path steering system and provided from the Coude' path to a beam director. A first steering input is provided in the beam director with an outer steering assembly and a second steering input is provided with an inner steering assembly. A centerline of the laser beam is thereby directed to substantially the same location on the window for the entire field of regard (FOR) of the laser weapon.

The features, functions, and advantages that have been discussed can be achieved independently in various embodiments of the present invention or may be combined in yet other embodiments further details of which can be seen with reference to the following description and drawings.

DETAILED DESCRIPTION

Figure 1:
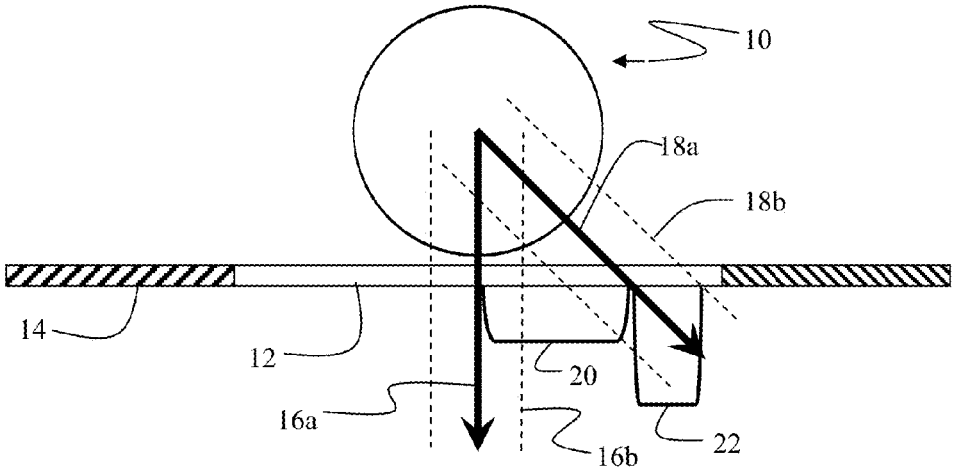
FIG. 1 PRIOR ART
FIG. 1 is a schematic representation of a prior art laser beam director mounted behind a conformal window.
Figure 2:
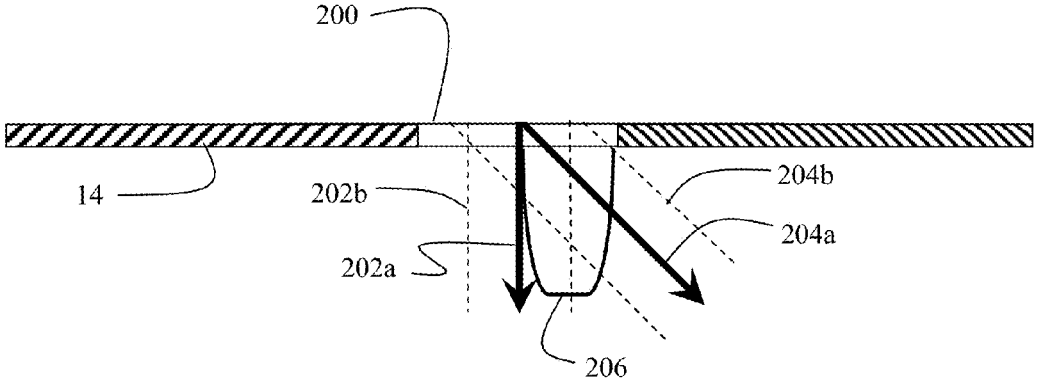
FIG. 2 is a schematic representation of an ideal laser beam origination at substantially a single point on a conformal window for the entire field of regard of the laser.

The embodiments described herein demonstrate a beam director integrated with a window which maintains the laser beam center at the same or substantially the same location on the enclosing window irrespective of the orientation at which the laser is projected. FIG. 1 shows a prior art beam director 10 mounted behind a window 12 in an aircraft structure 14. Such a conventional beam director (ball turret) located behind a window slews the beam across the window as the turret steers the beam. The direction of the beam shown with a first perpendicular aspect centerline 16*a* with a beam half-width 16*b* to a second angled aspect centerline 18*a* with a beam half-width 18*b* requires that the window have sufficient dimensions to accommodate the lateral displacement 20 of beam centerline impingement on the window for the desired field of regard (FOR) for the beam director and the additional width 22 required by the beam half-width 18*b* required by the beam angulation. FIG. 2 shows an exemplary window 200 for transmission of a directed laser beam centerline 202*a* at a perpendicular aspect, with beam half-width 202*b*, and at a maximum angled aspect centerline 204*a* for the desired FOR wherein the beam centerline is incident on the window in substantially an identical location. This allows window 200 to be of significantly reduced dimensions constrained only by the minor additional lateral extent 206 of the FOR for beam half-width 204*b* based on thickness of the window. Targeting of the beam centerline at the inner surface of the window or at a central location in the thickness of the window allows further tailoring of the window size based on thickness requirements to further reduce the lateral dimension required to accommodate the beam width.

Figure 3:
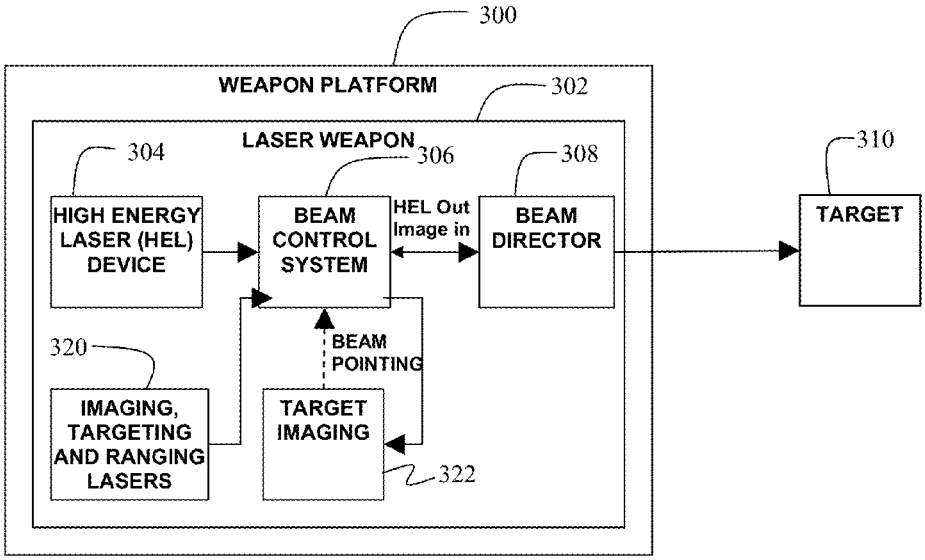
FIG. 3 is a block diagram of the integration of a laser weapon in a weapon platform.

FIG. 3 shows the basic functional diagram of elements for a weapon system employing a selected embodiment as disclosed herein. A weapons platform 300, typically an aircraft or other mobile carrier, is employed in which the laser weapon 302 is mounted. The laser weapon typically employs a high energy laser device (HEL) 304 that provides the high energy beam. A beam control system 306 shapes the beam and provides it to a beam director 308 which steers the pointing direction of the beam to a target 310. Supplemental elements for the system may include imaging, targeting and ranging lasers 320 which are directed through the beam control system and beam director, and target imaging systems 322 which employ target information reflected to the beam director and beam control system for refined beam pointing.

Figure 4:
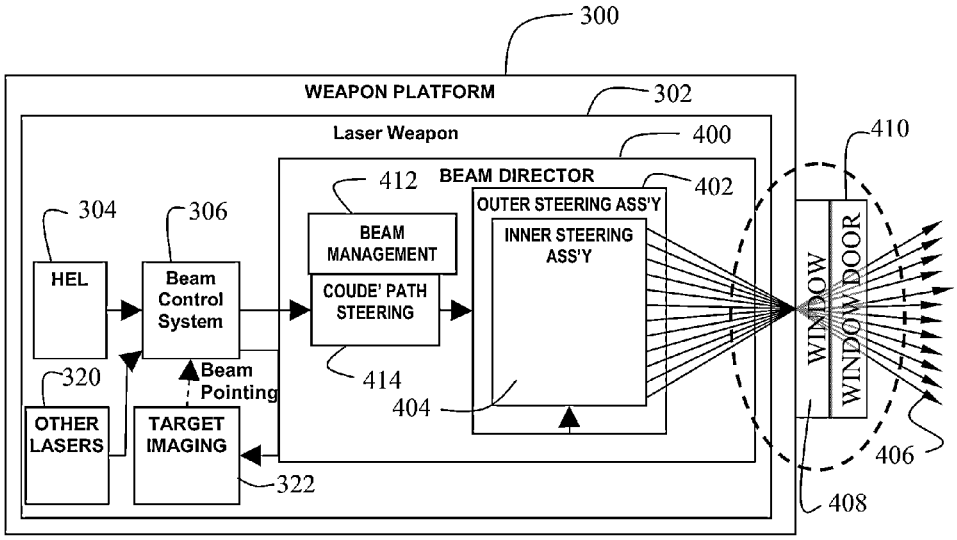
FIG. 4 is a block diagram of an integration of a laser weapon in a weapon platform with embodiments as disclosed herein for the beam director.

The present embodiments which will be discussed with respect to FIGS. 5-9 provide a refinement to the beam director of the generalized system of FIG. 3 as shown in FIG. 4. Beam director 400 incorporates an exemplary embodiment which substantially achieves the ideal characteristics described in FIG. 2. Steering of the laser beam received from the HEL 304 through beam control system 306 is accomplished with an outer steering assembly 402 in which an inner steering assembly 404 is nested. The combined inner and outer steering assemblies direct the laser beam provided to the beam director through the desired FOR as represented by the individual beam centers 406. Each beam passes in integral window 408 in the weapon platform 300. A movable door or cover 410 provides environmental protection for the window when the laser is not in use. As shown in the drawing, the beam centerlines for the entire FOR of the laser pass substantially through a single point proximate the center of the window. A beam management system 412 provides control for the inner and outer steering assemblies and includes a Coudé path 414 incorporating multiple relay mirrors controllable with appropriate steering for internally directing the beam within the weapons platform for feeding the laser beam into the steering assemblies. As previously described for the system in FIG. 3, other lasers 320 for imaging, targeting and ranging which are directed through the beam control system and beam director, and target imaging systems 322 which employ target information reflected to the beam director and beam control system for refined beam pointing are provided.

Figure 5:
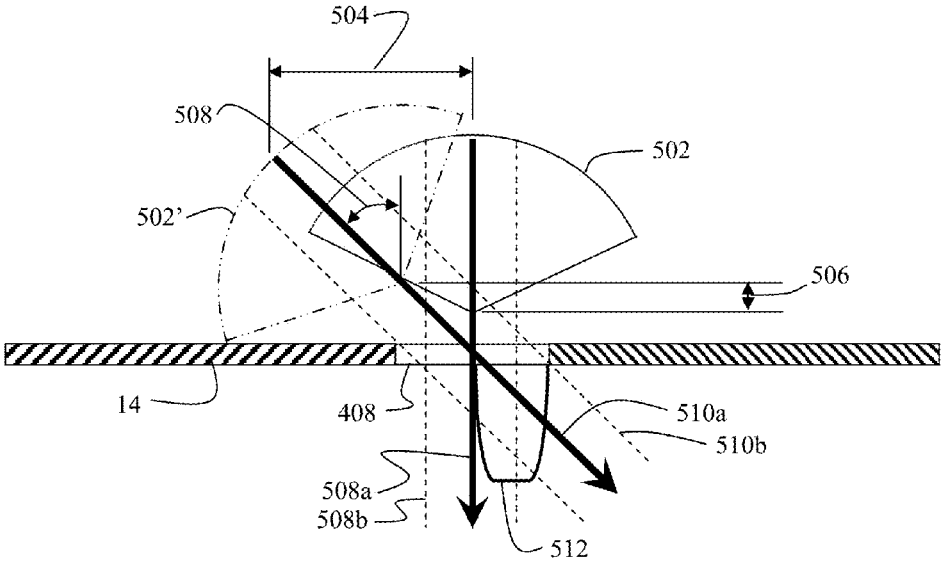
FIG. 5 is a first exemplary embodiment of a beam director.

A first exemplary embodiment of the beam director 400 is shown in FIG. 5 wherein a telescope 502 is mounted on a suitably shaped pantograph. The telescope maintains its orientation towards the center of window 408 as it moves in multiple axes on the pantograph. A maximum FOR position is shown by the telescope 502' in phantom. As shown in FIG. 5, the pantograph provides x-axis displacement 504, y axis displacement (perpendicular to the plane of the figure) and z-axis displacement 506 which provides the outer steering assembly to accommodate the positioning of the beam telescope behind the window. The telescope 502 is mounted on a rotational head to allow angular displacement 508 as the inner steering assembly placing the beam centerline at the same point on the window. The z-axis displacement provided by the outer steering assembly allows placement of the telescope structure closer to the window while accommodating the lateral dimension of the telescope in the rotated position induced by the inner steering assembly and allows fine positioning of the beam center on the window. The Coudé steering path 414 provides the laser beam to the telescope for projection. As shown in the drawing, the beam centerlines 508*a* and 510*a* corresponding to the two exemplary telescope orientations are directed through the center of the window. The beam half-widths 508*b* and 510*b* require only minimal lateral extension of the window to accommodate the total beam extent 512 from centerline through the entire FOR traversed by the telescope.

Figure 6:
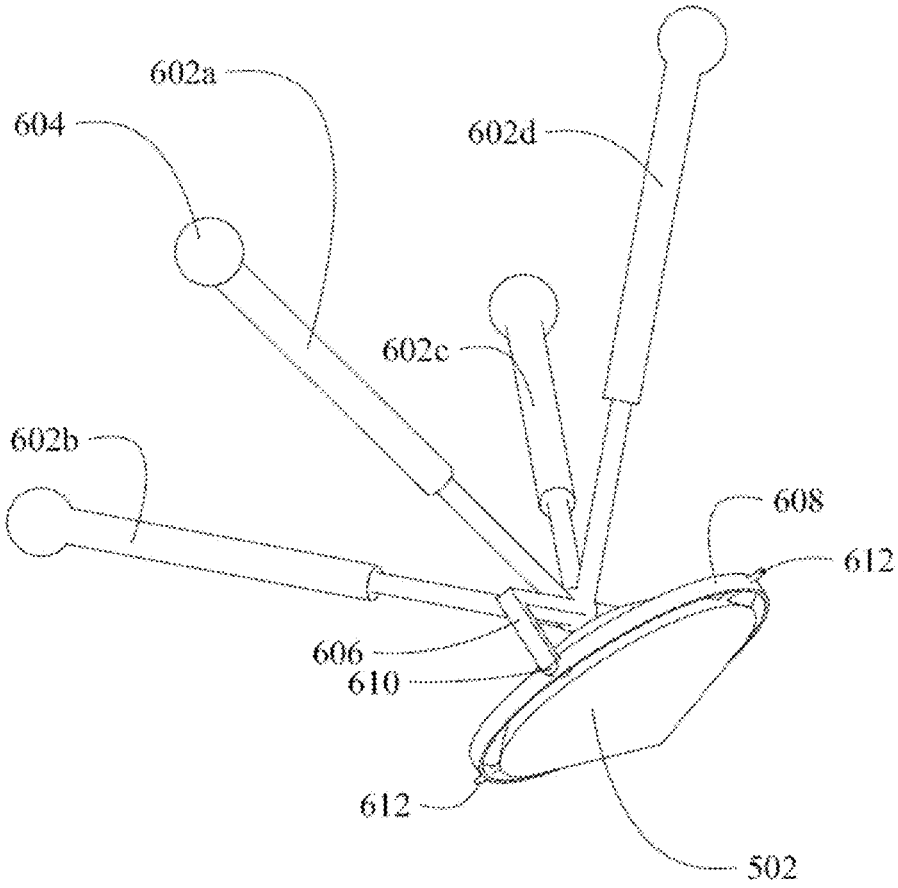
FIG. 6 is a pictorial drawing of a structural implementation of the beam director of FIG. 5.

FIG. 6 shows an exemplary pantograph and rotational head. For the embodiment in the drawings, four telescoping arms 602*a*, 602*b*, 602*c*, and 602*d* are pivotally mounted to the aircraft structure with ball joints 604 and support a telescope frame 606 with ball joint attachment. Hydraulic, pneumatic or electromechanical control of the telescoped length of the arms provides positioning of the telescope frame in an x, y and z orthogonal frame as the outer steering assembly. The telescope frame 606 supports a mounting hoop or bow 608 at rotational joints 610. Axial mounts 612 perpendicular to the rotational joints on the mounting hoop attach the telescope 502 to the hoop providing angular rotation in two axes as the inner steering assembly. Electrical, hydraulic or pneumatic actuation may be employed at the rotational joints and axial mounts for the angular rotation. The combined motion of the telescoping arms and rotation within the frame allows beam placement at a substantially identical incident point on the window 408 through a full conical FOR as described with respect to FIG. 5.

Figure 7:
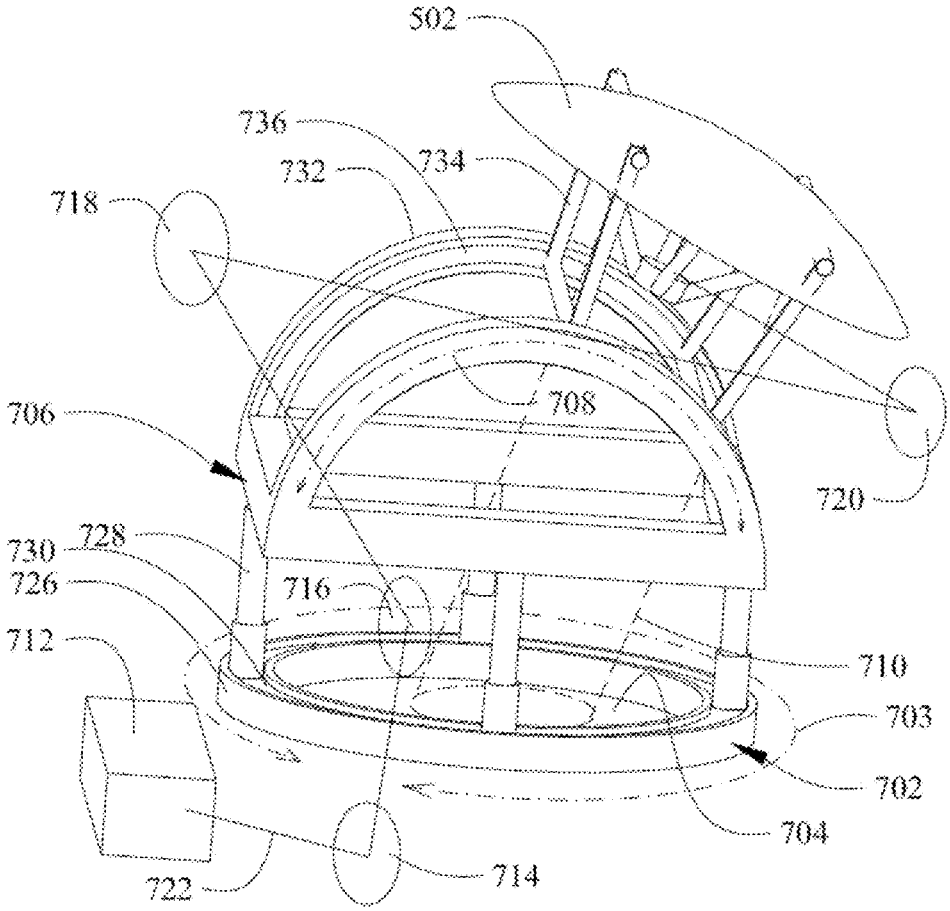
FIG. 7 is a pictorial drawing of a second structural implementation of the beam director of FIG. 5.

A second exemplary embodiment of the beam director is shown in FIG. 7 wherein a pair of gimbals is employed for steering the beam. A first gimbal 702 is positioned centered on the window 704 so that the rotation of the first gimbal 702 produces a change in the azimuth angle 703 of the first gimbal 702 with respect to the window 704. Mounted to the first gimbal 702 is a second gimbal 706 such that the rotation of the first gimbal 702 in the azimuth direction causes the second gimbal 706 to also rotate. Mounted to the second gimbal 706 is the telescope 502 from which the expanded laser beam 710 is projected. The second gimbal 706 rotates the telescope 502 in the elevation direction 708. The laser source 712 is connected to the telescope 502 through a series of optics 714, 716, 718 and 720 constituting the Coudé path for the input laser beam 722 to the telescope 502. For the embodiment shown in the drawing, the first gimbal is a tracked ring 726 supporting the second gimbal 706 with connecting posts 728 riding in the track 730. The second gimbal 706 is a pair of tracked arcs 732 carrying the telescope 502 with connecting arms 734 riding in tracks 736. Arms 734 from the telescope to the second gimbal or connecting posts 728 between the first and second gimbal may be telescoping attachments to allow motion perpendicular to the planes of gimbal motion for adjustment of the beam impingement on the window or clearance of the telescope in space constrained structural arrangements.

Figure 8:
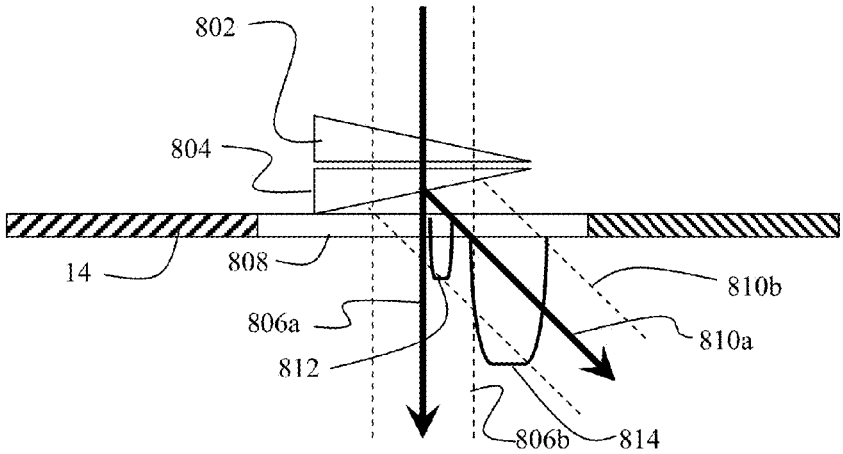
FIG. 8 is a second exemplary embodiment of a beam director.

A second exemplary embodiment of the beam director is shown in FIG. 8 wherein a pair of Risley prisms are employed for steering of the beam. A first prism 802 receives the beam from the Coude' path and passes the beam with a first angular displacement to a second prism 804 which induces a second angular displacement for allowing a full conical FOR for the beam director. As shown in the drawing, the prism pair provides a FOR from a beam centerline 806*a* impinging on window 808 to an angled beam centerline 810*a* impinging only slightly displaced from the perpendicular beam. In FIG. 8, the angled face of the second prism 804 displaces the beam exit point from the face of the window. However, the limited beam centerline displacement 812 that is actually induced is minor resulting in an additional window width to accommodate the beam with footprint 814 from the perpendicular beam half-width 806*b* to maximum angled beam half-width 810*b*.

Figure 9:
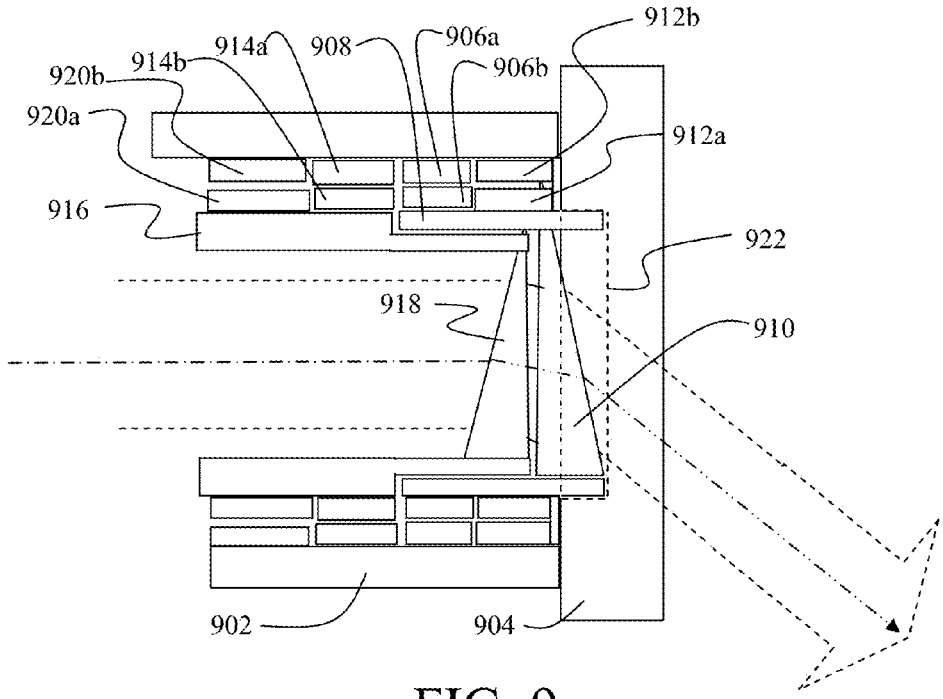
FIG. 9 is a side section view of a structural implementation of the beam director of FIG. 7; and, FIG. 10 is a flow chart of the method for beam direction implemented by the embodiments herein.

FIG. 9 demonstrates a control assembly structure for the Risley prisms and integral window which entirely accommodates the minor displacement by relieving the inner surface of the integral window to accommodate the angled face of the second prism. An assembly housing 902 provides structural mounting to integral window 904 and internal structure of the air vehicle (not shown). Bearings 906*a* and 906*b* support an outer mounting ring 908 for the outboard prism 910. Motor rotors 912*a* carried on the outer mounting ring are driven by motor stators 912*b* carried by the housing to power the outer steering assembly for the outboard prism. Similarly, inner bearings 914*a* and 914*b* support an inner mounting ring 916 carrying the inboard prism 918 and motor rotors 920*a* carried on the inner mounting ring are driven by motor stators 920*b* carried by the housing to power the inner steering assembly for the inboard prism. In alternative embodiments, the inboard and outboard prisms may be supported by an inner mounting ring and outer mounting ring respectively. A relief cutout 922 on the inner surface of the window allows the inner mounting ring and outboard prism to intrude into the window geometry thereby allowing the beam center line for all angles of the beam within the desired FOR to originate substantially at the same point in the window. Additional thickness of the window to accommodate structural requirements for the relief may be required with associated additional lateral extent of the window to accommodate beam width.

The embodiments disclosed reduce the window size and/or increase the FOR for a laser weapon with the beam projector mounted behind a window. This enables effective deployment on platforms including fast movers (e.g., B-1B) for which the aerodynamics require conformal mounting, or on stealth aircraft (e.g., B-2) for which the window presents a limitation on the stealth characteristics of the platform.

Figure 10:
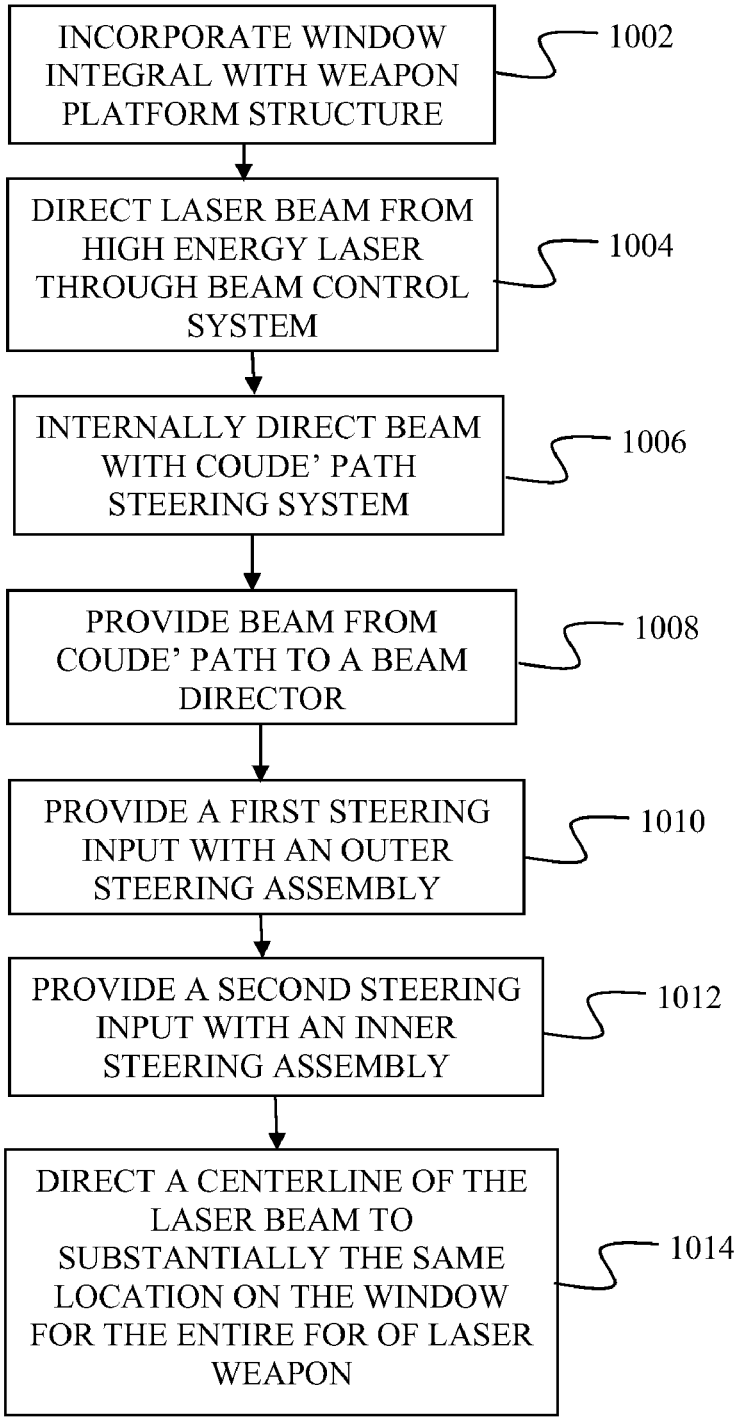

As demonstrated in FIG. 10, the embodiments for a beam director in a laser weapon on a weapon platform provide for incorporating a window integral with the structure of the weapon platform, step 1002. A laser beam from a high energy laser is directed through a beam control system, step 1004, and internally directed with a Coude' path steering system, step 1006. The beam from the Coude' path is provided to a beam director, step 1008, which provides a first steering input with an outer steering assembly, step 1010, and provides a second steering input with an inner steering assembly, step 1012, to direct a centerline of the laser beam to substantially the same location on the window for the entire field of regard (FOR) of the laser weapon, step 1014.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A laser system comprising:
a window integrated in the surface of a weapon platform;
a high energy laser mounted in the weapon platform and providing a laser beam;
a Coude' path receiving the laser beam for internal direction of the beam;
a beam director receiving the laser beam from the Coude' path and having an outer steering assembly and an inner steering assembly cooperatively providing pointing of a centerline of the laser beam at a substantially single location on the window for a full conical field of regard irrespective of the orientation at which the laser is projected.

2. The laser system as defined in claim 1 wherein the beam director comprises a telescope mounted on a pantograph.

3. The laser system as defined in claim 2 wherein
the outer steering assembly of the pantograph comprises a plurality of telescoping arms mounted to the weapon platform with ball joints;
the inner steering assembly comprises a telescope frame carried by the telescoping arms and rotationally supporting a mounting hoop for first angular rotation of the telescope and an axial support for the telescope from the mounting hoop for second angular rotation of the telescope.

4. The laser system as defined in claim 3 wherein the telescoping arms of the outer steering assembly provide 3 axis orthogonal positioning of the telescope frame for clearance of the telescope in rotational motion.

5. The laser system as defined in claim 2 wherein
the outer steering assembly is a first gimbal for azimuth positioning of the beam director;
and the inner steering assembly is a second gimbal mounted to the first gimbal and carrying the telescope for rotation in elevation to position a beam centerline of the laser beam at substantially the same location on the window.

6. The laser system as defined in claim 5 wherein the first gimbal is as tracked ring for rotation of the second gimbal in azimuth and the second gimbal is a pair of tracked arcs for rotation of the telescope in elevation.

7. A laser system comprising:
a window integrated in the surface of a weapon platform;

a high energy laser mounted in the weapon platform and providing a laser beam;

a Coude' path receiving the laser beam for internal direction of the beam;

a beam director receiving the laser beam from the Coude' path and having an outer steering assembly and an inner steering assembly cooperatively providing pointing of a centerline of the laser beam at a substantially single location on the window for a full conical field of regard wherein the beam director comprises a first Risely prism and a second Risely prism, and the outer steering assembly comprises an outer mounting ring supporting the first prism for rotational motion and the inner steering assembly comprises an inner mounting ring supporting the second prism for rotational motion.

8. A laser system comprising: The laser system as defined in claim 7 further comprising a housing wherein the inner mounting ring is supported by a first bearing set from the housing and rotational motion of the inner mounting ring is induced by a stator carried by the housing and a motor rotor mounted to the inner mounting ring and the outer mounting ring is supported by a second bearing set from the housing and rotational motion of the outer mounting ring is induced by a second stator carried by the housing and a second motor rotor mounted to the outer mounting ring.

9. The laser system as defined in claim 7 wherein the window is relieved to receive the inner mounting ring to allow the beam centerline of the laser beam to be positioned by the first and second Risely prisms to originate substantially at the same point in the window.

10. A laser comprising:

a window structurally integrated in a platform;

a high energy laser mounted in the weapon platform and providing a laser beam;

a Coude' path receiving the laser beam for internal direction of the beam;

a beam director having an outboard Risley prism mounted in an inner mounting ring supported by a first bearing set from a housing, a stator carried by the housing and a motor rotor mounted to the inner mounting ring, rotational motion of the inner mounting ring induced by the rotor and stator, and an inboard Risley prism mounted in an outer mounting ring supported by a second bearing set from the housing, second stator carried by the housing and a second motor rotor mounted to the outer mounting ring, rotational motion of the outer mounting ring is induced by the second rotor and stator, the window relieved to receive the outboard Risley prism and inner mounting ring for a beam centerline of the laser beam to be positioned by the outboard and inboard Risely prisms to originate substantially at the same point in the window.

11. A method for implementing beam control in a laser comprising:

incorporating a window integral with the structure of the weapon platform;

directing a laser beam from a high energy laser through a beam control system;

internally directing the beam with a Coude' path steering system;

providing the beam from the Coude' path to a beam director;

providing a first steering input with an outer steering assembly;

providing a second steering input with an inner steering assembly; and, directing a centerline of the laser beam to substantially the same location on the window for the entire field of regard (FOR) of the laser irrespective of the orientation at which the laser is projected.

12. The method of claim 11 wherein providing a first steering input comprises:

providing a plurality of telescoping arms mounted to the weapon platform with ball joints, and and wherein providing the second steering input comprises:

providing a telescope frame carried by the telescoping arms and rotationally supporting a mounting hoop for a telescope for first angular rotation and axially supporting the telescope from the mounting hoop for second angular rotation.

13. The method of claim 12 wherein the step of providing a plurality of telescoping arms includes providing 3-axis orthogonal positioning of the telescope frame for clearance of the telescope in rotational motion.

14. The method of claim 11 wherein providing a first steering input comprises providing a first gimbal for rotation in azimuth and wherein providing a second steering input comprises mounting a second gimbal to the first gimbal for rotation in elevation.

15. The method of claim 14 wherein the first gimbal is a tracked ring and the second gimbal is a pair of tracked arcs.

16. The method of claim 15 wherein the step of mounting the second gimbal to the first gimbal comprises providing telescoping connecting posts and further comprising adjusting the telescope with the telescoping connecting posts.

17. A method for implementing beam control in a laser comprising:

directing a laser beam from a high energy laser through a beam control system;

internally directing the beam with a Coude' path steering system;

providing the beam from the Coude' path to a beam director;

providing a first steering input with an outer steering assembly;

providing a first Risely prism, providing an outer mounting ring supporting the first prism or rotational motion;

providing a second Risely prism, and providing an inner mounting ring supporting the second prism for rotational motion; and, directing a centerline of the laser beam to substantially the same location on the window for the entire field of regard (FOR) of the laser.

18. The method of claim 17 further comprising:

recessing the window to receive an outboard one of the first and second prism and associated inner and outer mounting ring.

* * * * *